US007567682B2

(12) United States Patent
Yamada et al.

(10) Patent No.: US 7,567,682 B2
(45) Date of Patent: Jul. 28, 2009

(54) AUDIO PROCESSING APPARATUS

(75) Inventors: Yuji Yamada, Tokyo (JP); Hirofumi Kurisu, Kanagawa (JP); Kiyofumi Inanaga, Kanagawa (JP)

(73) Assignee: Sony Corporation (JP)

( * ) Notice: Subject to any disclaimer, the term of this patent is extended or adjusted under 35 U.S.C. 154(b) by 928 days.

(21) Appl. No.: 11/107,633

(22) Filed: Apr. 14, 2005

(65) Prior Publication Data

US 2005/0185810 A1 Aug. 25, 2005

Related U.S. Application Data

(63) Continuation of application No. 09/675,101, filed on Sep. 28, 2000, now Pat. No. 6,928,179.

(30) Foreign Application Priority Data

Sep. 29, 1999 (JP) ..... P11-276747

(51) Int. Cl.
*H04R 5/02* (2006.01)

(52) U.S. Cl. ..... 381/311; 381/309; 381/310

(58) Field of Classification Search ..... 381/309, 381/310, 311, 300, 1, 74, 370
See application file for complete search history.

(56) References Cited

U.S. PATENT DOCUMENTS

| | | | | |
|---|---|---|---|---|
| 5,687,239 | A * | 11/1997 | Inanaga et al. | 381/309 |
| 5,844,816 | A * | 12/1998 | Inanaga et al. | 702/145 |
| 6,108,430 | A | 8/2000 | Kurisu et al. | |
| 6,178,247 | B1 | 1/2001 | Ogita et al. | |
| 6,269,166 | B1 | 7/2001 | Matsuo et al. | |
| 6,307,941 | B1 | 10/2001 | Tanner, Jr. et al. | |
| 6,614,912 | B1 | 9/2003 | Yamada et al. | |
| 6,681,018 | B1 * | 1/2004 | Asakura et al. | 381/18 |
| 6,970,569 | B1 * | 11/2005 | Yamada | 381/310 |
| 2001/0050993 | A1 | 12/2001 | Douglas | |

FOREIGN PATENT DOCUMENTS

| | | | |
|---|---|---|---|
| JP | 2-145900 | U | 12/1990 |
| JP | 5-115099 | A | 5/1993 |
| JP | 5-252598 | A | 9/1993 |
| JP | 8-079900 | A | 3/1996 |
| JP | 10-201000 | A | 7/1998 |
| JP | 10-294999 | A | 11/1998 |
| WO | WO-9940756 | | 8/1999 |

OTHER PUBLICATIONS

Japanese Office Action issued on Jun. 19, 2008 in connection with corresponding Japanese Application No. HEI 11-276747 (2 pages).

* cited by examiner

*Primary Examiner*—Vivian Chin
*Assistant Examiner*—Con P Tran
(74) *Attorney, Agent, or Firm*—Lerner, David, Littenberg, Krumholz & Mentlik, LLP

(57) ABSTRACT

An audio processing apparatus has converting means for converting n-channel (positive integral number: n≧1) audio signals input from at least one sound source into two-channel signals, a pair of correcting filter means to which a pair of two-channel signals converted by the converting means are supplied and which corrects a difference of the sense of hearing due to a difference of headphone characteristics, and an output section for supplying a pair of output signals from the pair of correcting filter means to right and left speaker units of a headphone.

1 Claim, 9 Drawing Sheets

AUDIO PROCESSING APPARATUS

This application is a continuation of application Ser. No. 09/675,101, filed Sep. 28, 2000 now U.S. Pat. No. 6,928,179.

BACKGROUND OF THE INVENTION

1. Field of the Invention

The present invention relates to an audio processing apparatus which is suitably applied to reproduction of a stereo audio signal of a multi-channels by means of a headphone device.

2. Description of the Related Art

Recently, multi-channel signals are used mostly as audio signals (sound signals) of an image of cinema and the like, and such signals are recorded on the assumption that the signals are reproduced by speakers on both sides and at the center of an image or speakers beyond or on both sides of a listener. As a result, a sound source in the image matches with a position of an actually audible sound image, and a naturally widespread sound field is established.

However, in the case where such a sound is appreciated by using a prior headphone device, a sound image by sound input is localized in a head, and an image position does not match with a sound image localized position so that the sound image localization becomes extremely unnatural. Further, the localization positions of sound signals of respective channels cannot be reproduced separately. Needless to say, a case that only a sound of multi-channels such as musical sounds is appreciated has the similar problems, namely, a sound is heard from a head unlike reproduction via speakers, and thus the sound image localized positions are not separated so that the reproduction of a sound field is extremely unnatural.

As a method which improves this phenomenon, namely, which obtains a sound file which is equal to that in the case of reproducing a sound via speakers even if a sound is heard via a headphone device, there considers a method such that transfer functions from speakers previously positioned for respective channels to both ears of a listener are measured or calculated and is superposed on an audio signal by a filter such as a digital filter, and a sound is heard via a headphone device. FIG. 8 is a diagram showing one example of a prior headphone device to which this method is applied. Stereo audio signals of right and left two channels obtained at input terminals 1L and 1R are converted into digital audio signals by analog/digital converters 2L and 2R. The audio signals of the right and left channels output from the analog/digital converters 2L and 2R are supplied to a digital processing circuit 3. The digital processing circuit 3 is composed of a plurality of digital filters 3LL, 3LR, 3RL and 3RR, and two adders 4L and 4R. The digital processing circuit 3 executes a converting process such that a reproduction sound field similar to a reproduction sound field obtained when a speaker device is positioned indoors is obtained by a headphone device (a process for converting a so-called stereophonic sound into a binaural sound).

A concrete structure of the digital processing circuit 3 is such that an audio signal of the left channel is supplied to the first digital filter 3LL and the second digital filter 3LR, and an audio signal of the right channel is supplied to the third digital filter 3RL and the fourth digital filter 3RR. The respective digital filters have a structure shown in FIG. 9, for example. The digital filter shown in FIG. 9 is an FIR type filter, and a signal obtained at an input terminal 111 is supplied to a plurality of delay circuits 112*a*, 112*b*, . . . 112*m*, 112*n* which are connected continuously. The signal obtained at the input terminal 111 and output signals of the delay circuits 112*a* through 112*n* are supplied to individual coefficient multipliers 113*a*, 113*b*, . . . 113*n* and 1130 so as to be multiplied by coefficient values set in the respective multipliers, and the multiplied signals are added respectively in adders 114*a*, 114*b*. . . 114*m* and 114*n* successively, and an output obtained by adding all the coefficient-multiplied signals is obtained at an output terminal 115.

An output of the first digital filter 3LL having the above structure and an output of the third digital filter 3RL are supplied to the adder 4L so as to be added, and a converted output for the left channel is obtained. Moreover, an output of the second digital filter 3LR and an output of the fourth digital filter 3RR are supplied to the adder 4R so as to be added, and a converted output for the right channel is obtained.

The output of the left channel obtained by addition in the adder 4L is supplied to an digital/analog converter 5L so as to be converted into an analog audio signal. The converted analog audio signal is amplified by an amplifying circuit 6L for driving a headphone, and the amplified signal is supplied to a speaker unit 7L for a left ear in a headphone device 7. Further, the output of the right channel obtained by addition in the adder 4R is supplied to a digital/analog converter 5R so as to be converted into an analog audio signal. The converted analog audio signal is amplified by an amplifying circuit 6R for driving a headphone, and the amplified signal is supplied to a speaker unit 7R for a right ear in the headphone device 7.

There will be explained below a principle that an audio signal for stereophonic reproduction is converted into an audio signal for binaural reproduction in the process in the digital processing circuit 3 with reference to FIG. 10. A speaker device SL for the left channel is positioned on a left front side of a listener and a speaker device SR for the right channel is positioned on a right front side. Audio signals for stereophonic reproduction are reproduced respectively from the respective speaker devices. At this time, as for a sound which reaches a left ear of the listener, a sound arrived from the speaker device SL of the left channel has a transfer function HLL, and a sound arrived from the speaker device SR of the right channel has a transfer function HRL. Moreover, as for a sound which reaches a right ear of the listener, a sound arrived from the speaker device SR of the right channel has a transfer function HRR, and a sound arrived from the speaker device SL of the left channel has a transfer channel HLR.

Coefficient values of the coefficient multipliers of the respective digital filters are set so that the four transfer functions HLL, HLR, HRL and HRR are reproduced according to the operations in the four digital filters 3LL, 3LR, 3RL and 3RR. As a result, two-channel audio signals for stereophonic reproduction are converted into two-channel audio signals for binaural reproduction. In this case, the transfer functions of an impulse response to both ears from the speaker devices of the respective channels are measured in a resonant room, and the coefficient values to be set in the coefficient multipliers of the digital filters are set based on the measured values. FIG. 11 shows one example of the measured impulse response data.

Here, Japanese Patent Publications (Patent No. 2751155 and the like) which have been applied by the inventors of the present invention discloses details of the process for converting the audio signal for stereophonic reproduction into the audio signal for binaural reproduction.

According to the processing apparatus which have been suggested, a sound image is localized outside of a head of a listener. However, more precisely, in the case where an audio signal converted for binaural reproduction is heard by a headphone, transfer functions from right and left speaker units of the headphone to both ears of the listener function, a characteristic slightly different from the case that a sound is heard from an actual sound source appears.

In addition, the transfer functions from the headphone to both ears of the listener vary with types of a headphone. Therefore, in the case where another type of a headphone is used, there occasionally arises a problem that the localizing state of a sound image varies.

The present invention has been achieved in order to solve the above problems, and it is an object of the invention to be capable of realizing accurate sound image localization similar to that in the case of using speakers when an audio signal for stereophonic reproduction is converted into an audio signal for binaural reproduction and a sound is heard via a headphone.

SUMMARY OF THE INVENTION

The present invention includes: converting means for converting n-channel (positive integral number: $n \geqq 1$) audio signals supplied from at least one signal source into two-channel output signals; a pair of correcting filter means to which a pair of two-channel signals converted by the converting means are supplied, the correcting filter means converting a difference of hearing sense due to a difference between right and left characteristics of a headphone; and an output section for supplying a pair of output signals from the pair of correcting filter means to right and left speaker units of the headphone.

According to the present invention, a difference of heating sense due to a difference between the headphone characteristics is corrected by the correction filter means so that a sound having the characteristic for binaural reproduction reaches right and left ears of a listener accurately.

DETAILED DESCRIPTION OF THE PREFERRED EMBODIMENTS

Figure 1:
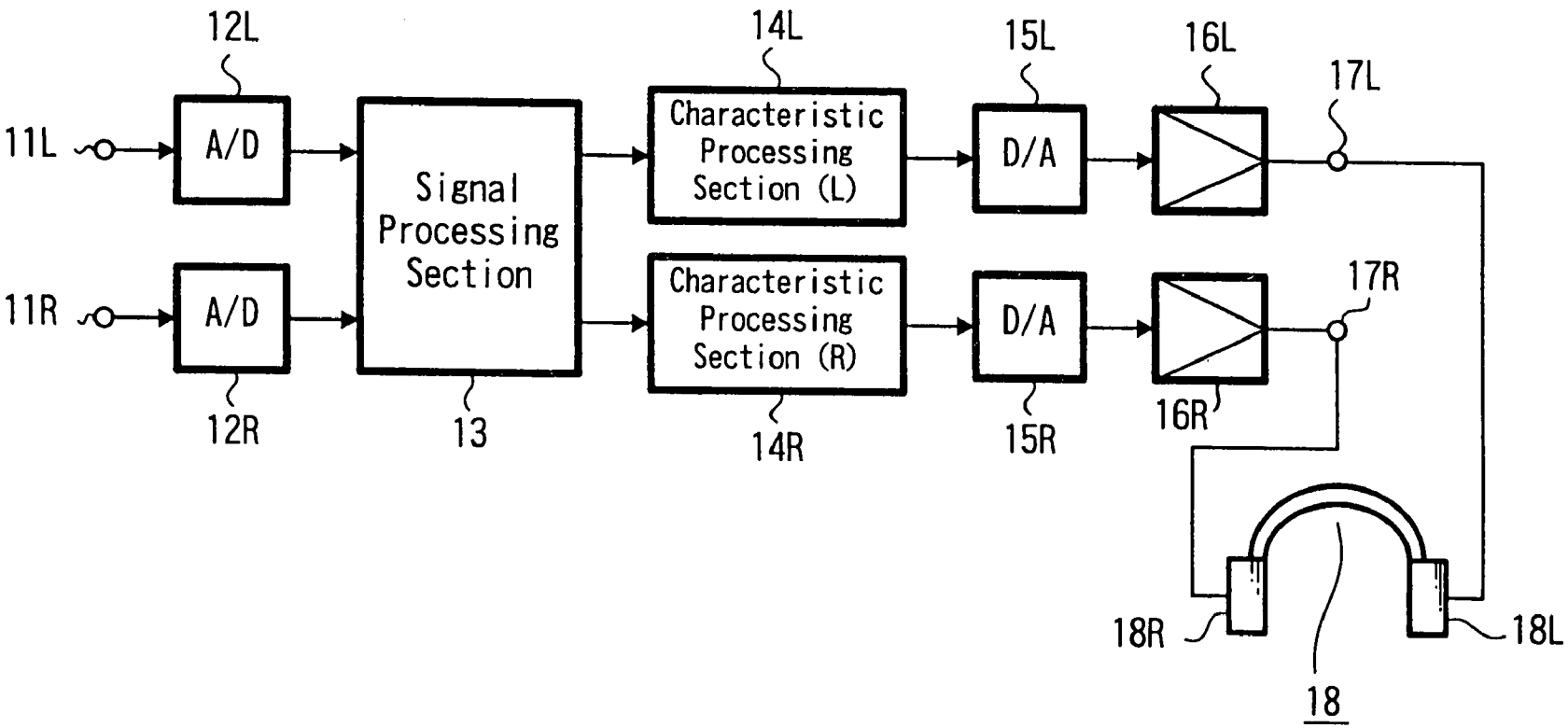
FIG. 1 is a block diagram showing an example of a whole structure according to a first embodiment of the present invention.
Figure 2:
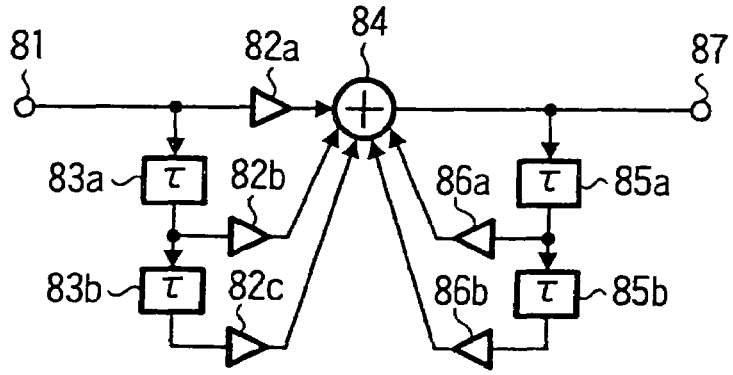
FIG. 2 is a structural diagram showing an example of an 11R filter.
Figure 3:
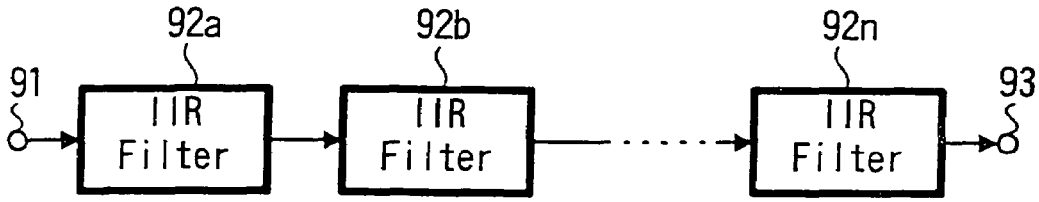
FIG. 3 is a structural diagram showing an example that a characteristic correcting section is composed of the 11R filter according to the first embodiment of the present invention.

There will be explained below a first embodiment of the present invention with reference to FIGS. 1 through 3.

In the present embodiment, audio signals for stereophonic reproduction obtained at input terminals 11L and 11R are converted into audio signals for binaural reproduction so as to be supplied to a headphone device connected to this apparatus and be reproduced. FIG. 1 is a diagram showing a whole structure of the present embodiment. A left channel signal and a right channel signal composing a two-channel audio signals for stereophonic reproduction are supplied to the left channel audio signal input terminal 11L and the right channel audio signal input terminal 11R. The audio signals obtained at the terminals 11L and 11R respectively are converted into digital audio signals by analog/digital converters 12L and 12R for the respective channels.

Figure 8:
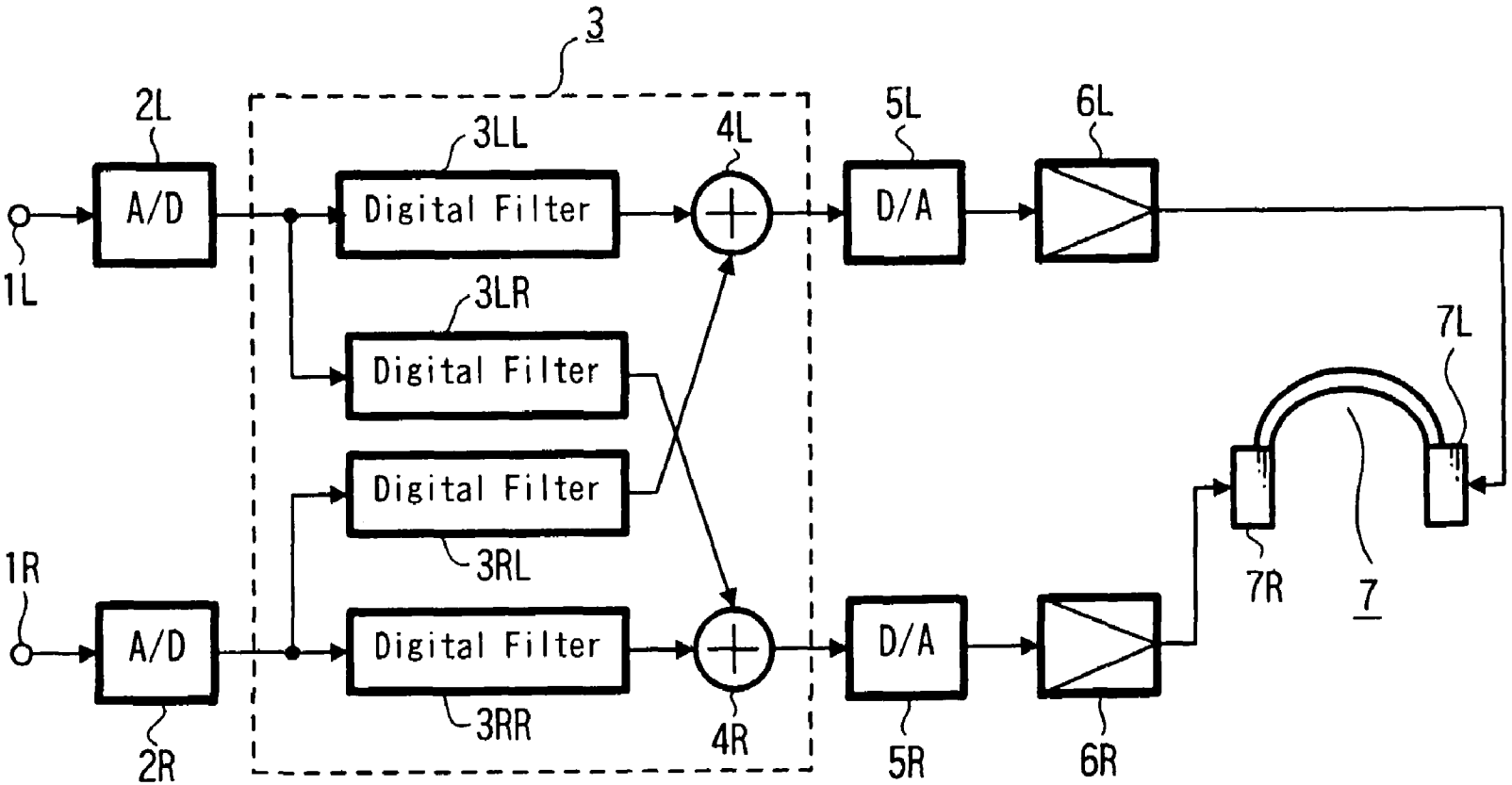
FIG. 8 (PRIOR ART)
FIG. 8 is a structural diagram showing one example of a structure of a prior audio processing apparatus.

The converted audio signals of the respective channels are supplied to a signal processing section 13. The signal processing section 13 is a circuit for converting the audio signals into two-channel audio signals forming a sound field for headphone reproduction based on two-system impulse responses from a sound source to the left ear and right ear of a listener. The signal processing section 13 is a circuit based on the principle similar to that of the digital processing circuit 3 shown in FIG. 8 of the prior art, and it is composed of digital filters such as FIR filters, adders and the like. Coefficient values which are multiplied by coefficient multipliers of the digital filters are set based on an actually measured value of a two-system impulse response from the sound source to the left ear and the right ear of the listener. In this case, such respective digital filters can execute very large-scale operations of about several thousand taps, for example.

Figure 9:
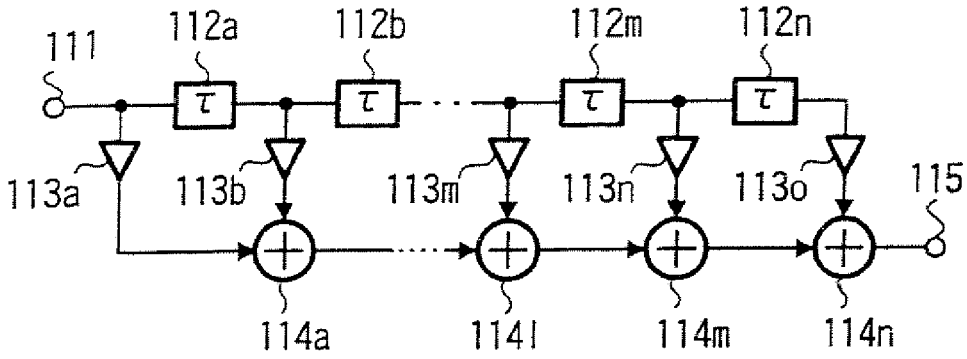
FIG. 9 (PRIOR ART)
FIG. 9 is a structural diagram showing one example of a digital filter.
Figure 10:
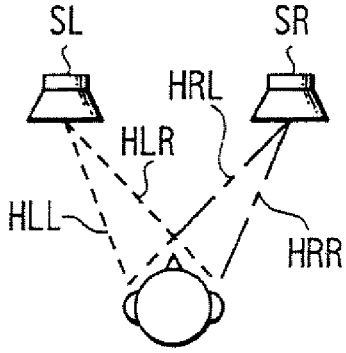
FIG. 10 (PRIOR ART)
FIG. 10 is an explanatory diagram for explaining an out-of-head sound image localizing process.
Figure 11:
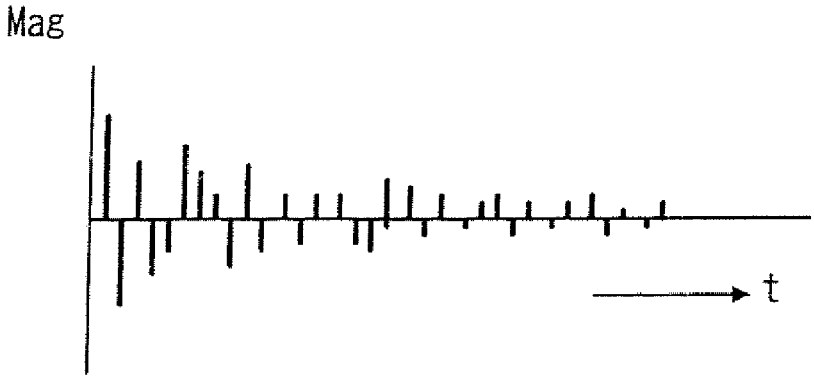
FIG. 11 (PRIOR ART)
FIG. 11 is a characteristic chart showing an example of impulse response data.

In the present embodiment, the audio signal of the left channel processed in the signal processing section 13 is supplied to the characteristic correcting section 14L for the left channel, and the audio signal of the right channel processed in the signal processing section 13 is supplied to the characteristic correcting section 14R of the right channel. The headphone characteristics are corrected respectively in the characteristic correcting sections 14L and 14R. The correction in the characteristic correcting sections 14L and 14R is for correcting a difference of the sense of hearing due to a characteristic difference of a headphone (a headphone device 18, mentioned later) to be used. For example, FIR type digital filters (digital filters having the structure shown in FIG. 9) are used for the correction.

That is, when a transfer characteristic of the left channel from a left speaker unit (driver) incorporated in the headphone attached to a listener to the listener's left ear is $Hhl_1$, multiplying coefficients or the like of the respective multipliers composing the filters are set in the filters composing the characteristic correction section 14L for the left channel so that a reverse characteristic of the transfer characteristic Hhl1 [$1/Hhl_1$] is superposed as impulse response data on a time area. Moreover, when a transfer characteristic of the left channel from a right speaker unit (driver) incorporated in the headphone attached to the listener to the listener's right ear is $Hlr_1$, multiplying coefficients or the like of the respective multipliers composing filters are set in the filters composing the characteristic correcting section 14R for the right channel so that a reverse characteristic of the transfer characteristic Hlr1 [$1/Hlr_1$] is superposed as impulse response data on the time area. Here, in the case where the FIR type digital filters are used as the characteristic correcting sections 14L and 14R, digital filters in which a circuit scale is comparatively small, namely, of about several hundred taps, for example, are used.

The right and left audio signals corrected in the characteristic correcting sections 14L and 14R are supplied to digital/analog converters 15L and 15R for respective channels, respectively, so as to be converted into analog audio signals. The right and left analog audio signals of two channels are amplified by amplifiers 16L and 16R for driving a headphone with a comparatively small amplification factor, and are supplied to headphone connection terminals 17L and 17R. Connection plugs (not shown) of the headphone device 18 are inserted into the headphone connection terminals 17L and 17R so that the audio signals for the respective channels obtained at the headphone connection terminals 17L and 17R are supplied to the right and left speaker units 18L and 18R of the connected headphone device 18, and audio is reproduced from the headphone device 18.

According to this structure, the sound field which is reproduced from the headphone device 18 and is heard by the listener becomes as satisfactory as a sound field formed by original audio signals for two channels from a speaker device installed in a room. In the present embodiment, since the headphone characteristics are corrected by the characteristic correcting sections 14L and 14R, the transfer characteristics from the right and left drivers of the headphone device 18 to be used to both the ears of the listener are corrected. Therefore, a sound image in which a sound to be heard by the listener is localized matches the position of the sound source of the input audio signals accurately. Particularly in the present embodiment, since the correction is executed independently by using the individual correction processing sections 14L and 14R for the right and left channels, the headphone characteristics are corrected accurately in the right and left channels so that the sound image, which has natural sound quality very close to the case where a sound is heard by using an installation type speaker device, can be reproduced.

In the above explanation, the FIR type digital filters are used as the filters composing the correction processing sections 14L and 14R, but digital filters having another structure may be used. For example, IIR type digital filters may be used. FIG. 2 is a diagram showing a structural example of the IIR type digital filter, and this example shows a secondary IIR type filter. There will be explained below its structure. An input signal obtained at an input terminal 81 is supplied to an adder 84 via a coefficient multiplier 82*a*, and the input signal is delayed by a delay circuit 83*a*. Thereafter, the delayed input signal is supplied to the adder 84 via a coefficient multiplier 82*b*. Further, the output of the delay circuit 83*a* is delayed by a delay circuit 83*b* so as to be supplied to the adder 84 via a coefficient multiplier 82*c*. Moreover, the added output of the adder 84 is supplied to an output terminal 87, and after the added output is delayed by a delay circuit 85*a*, the delayed output is supplied to the adder 84 via a coefficient multiplier 86*a*. Further, the output of the delay circuit 85*a* is delayed by a delay circuit 85*b* so as to be supplied to the adder 84 via a coefficient multiplier 86*b*. The respective supplied signals are added in the adder 84 so that the added output is obtained.

The secondary IIR type digital filters having such a structure are connected in a series in plural stages so that the correction processing section is constituted. Namely, an input terminal 91 of the correction correcting section is supplied to an IIR type filter 92*a* in the first stage, an output of the filter 92*a* is supplied to an IIR type filter 92*b* in the second stage, and hereinafter the IIR type filters which are connected in a series are supplied successively, and an output of the IIR type filter 92*n* in the final stage is supplied to an output terminal 93 of the correction processing section. In the case where the respective correction processing sections 14L and 14R are constituted according to such a structure, the characteristic correcting process which is similar to that in the case where the FIR type filters are used can be executed.

Furthermore, analog filters composed of an analog circuit having substantially similar correcting characteristic may be constituted as the correction processing sections 14L and 14R.

Figure 4:
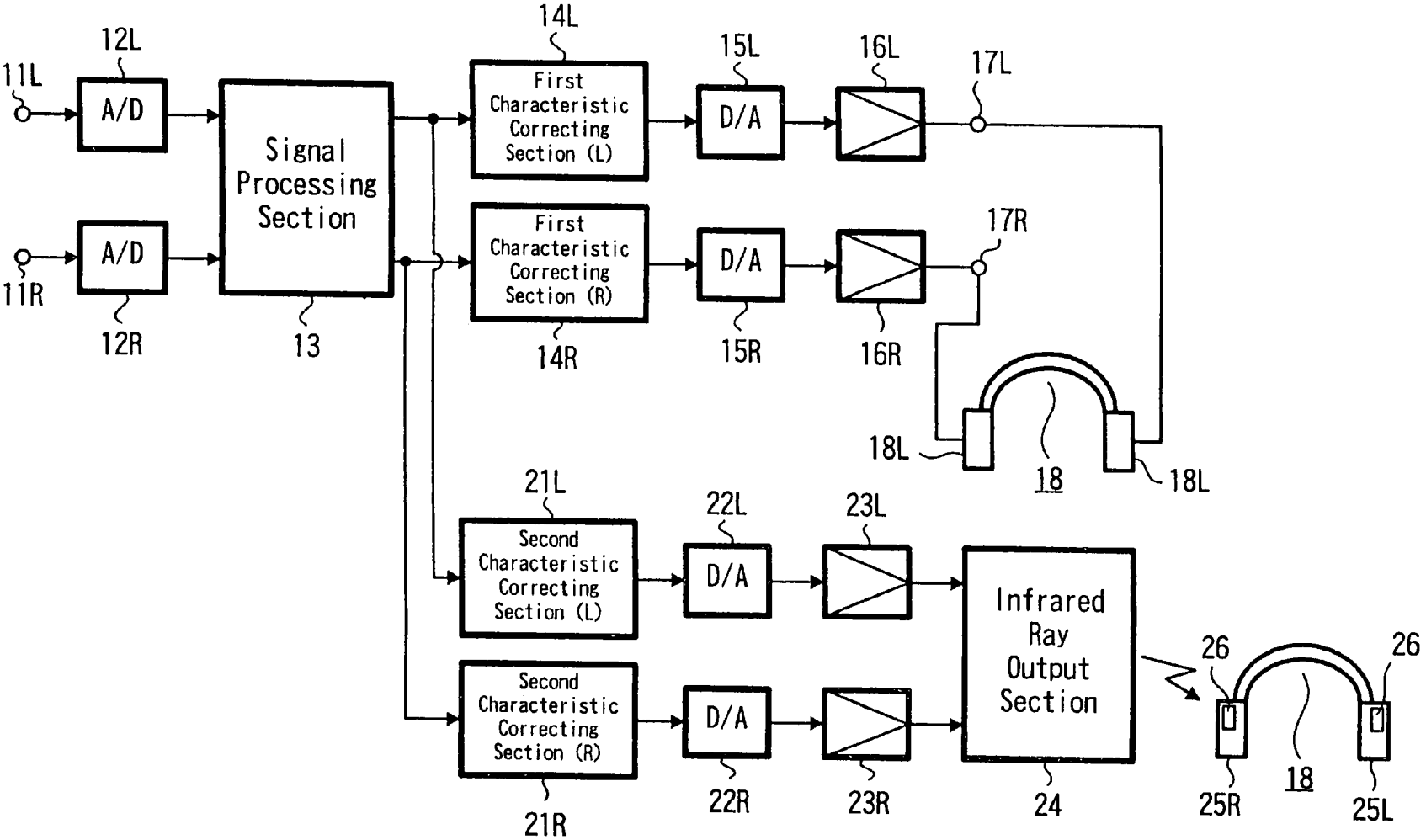
FIG. 4 is a block diagram showing an example of a whole structure according to a second embodiment of the present invention.

There will be explained below a second embodiment of the present invention with reference to FIG. 4. In FIG. 4, the same reference numerals are given to the portions corresponding to those in FIG. 1 described in the embodiment 1, and the detailed explanation thereof is omitted.

Also in the present embodiment, audio signals for stereophonic reproduction obtained at the input terminals 11L and 11R are converted into audio signals for binaural reproduction, and the converted signals are supplied to the headphone device connected to this apparatus so as to be reproduced. In the present embodiment, different two types of headphone devices can be connected to the apparatus.

There will be explained below a structure of the present embodiment. FIG. 4 is a diagram showing a whole structure of the present embodiment. A left channel signal and a right channel signal composing two-channel audio signals for stereophonic reproduction are supplied to the left channel audio signal input terminal 11L and the right channel audio signal input terminal 11R. The audio signals obtained at the terminals 11L and 11R respectively are converted into digital audio signals by the analog/digital converters 12L and 12R for the respective channels. The converted audio signals of the respective channels are supplied to the signal processing section 13. The signal processing section 13 is a circuit for converting the audio signals into a two-channel audio signals forming a sound field for headphone reproduction based on two-system impulse responses from a sound source to the left ear and right ear of a listener. This part of the structure is the completely same as that of the circuit described in the first embodiment.

Thereafter, the audio signal of the left channel processed in the signal processing section 13 is supplied to a first characteristic correcting section 14L for the left channel, and the audio signal of the right channel processed in the signal processing section 13 is supplied to a first characteristic correcting section 14R of the right channel. The headphone characteristics are corrected in the first characteristic correcting sections 14L and 14R. The correcting processes in the first correcting sections 14L and 14R are the completely same as the process for correcting a difference of the sense of hearing due to a characteristic difference of the headphone device 18 described in the first embodiment. The configuration of the circuit is the same as that of the characteristic correcting sections, 14L and 14R in FIG. 1.

That is, the characteristic correcting sections 14L and 14R are composed of filter means such as FIR type digital filters, respectively. When a transfer characteristic of the left channel from a driver incorporated in the headphone device 18 attached to a listener to the listener's left ear is $Hhl_1$ and a transfer characteristic of the right channel is $Hlr_1$, a reverse characteristic of the transfer characteristic Hhl1 $[1/Hhl_1]$ is superposed as impulse response data on a time area in the filter composing the characteristic correcting section 14L for the left channel, and a reverse characteristic of the transfer characteristic $Hlr_1$ $[1/Hlr_1]$ is superposed as impulse response data on the time area in the filter composing the characteristic correcting section 14R for the right channel.

The right and left audio signals corrected in the characteristic correcting sections 14L and 14R are supplied to digital/analog converters 15L and 15R for respective channels, respectively, so as to be converted into analog audio signals. The right and left analog audio signals of two channels are amplified by amplifiers 16L and 16R for driving a headphone with a comparatively small amplification factor, and are supplied to headphone connection terminals 17L and 17R. The audio is reproduced from the right and left speaker units 18L and 18R of the connected headphone device 18. The above structure and process are the same as those described in the first embodiment.

In the present embodiment, the audio signals of the right and left 2 channels output from the signal processing section 13 are supplied also to second characteristic correcting sections 21L and 21R. As for the structure of the characteristic correcting sections 21L and 21R, they are composed of filter means such as the FIR type digital filters similarly to the first characteristic correcting sections 14L and 14R, and characteristics to be corrected are different.

That is, when a transfer characteristic of the left channel from a driver incorporated in a headphone device (here, a codeless headphone device 25, mentioned later) to which the audio signals processed in the second characteristic correcting sections-21L and 21R are supplied is $Hhl_2$ and a transfer characteristic of the right channel is $Hlr_2$, a reverse characteristic of the transfer characteristic $Hhl_2$ $[1/Hhl_2]$ is superposed as impulse response data on a time area in the filters composing the second characteristic correcting section 21L for the left channel, and a reverse characteristic of the transfer characteristic $Hlr_2$ $[1/Hlr_2]$ is superposed as impulse response data on the time area in the filters composing the second characteristic correcting section 21R for the right channel.

The right and left audio signals corrected in the second characteristic correcting sections 21L and 21R are supplied to digital/analog converters 22L and 22R for respective channels, respectively, so as to be converted into analog audio signals. The right and left analog audio signals of two channels are amplified by amplifiers 23L and 23R so as to be supplied to an infrared signal output section 24. The infrared signal output section 24 is a circuit for outputting the supplied audio signals for the two channels as infrared signals with a predetermined bandwidth, and for example, an infrared light-emitting diode is used as infrared signal output means.

The infrared signals output from the infrared signal output section 24 are received by an infrared signal light receiving section 26 of the codeless headphone device 25 installed in the vicinity of the apparatus (for example, within several meters of distance), and the received audio is reproduced from right and left speaker units 25L and 25R of the codeless headphone device 25.

According to this structure, the sound image, which is reproduced by the headphone device 18 directly connected with the headphone connection terminal 17L and 17R amd is heard by a listner, becomes satisfactory in that a difference in the headphone characteristics is corrected by the first characteristic correcting sections 14L and 14R. Moreover, the sound image, which is reproduced from the codeless headphone device 25 receiving the infrared signals from the infrared ray output section 24 and is heard by a listener, becomes satisfactory in that a difference of the headphone characteristics is corrected by the second characteristic correcting sections 21L and 21R.

Therefore, even if the headphone characteristics (namely, the transfer characteristics from the drivers to both ears of the listener) are different from each other between the headphone device 18 and the codeless headphone device 25, the positions where the sound images which are reproduced from the respective headphone devices and are heard by the listener are localized become equal to each other. As a result, in both the cases where those headphone devices are used, the audio in which the sound images are localized in the correct positions can be heard.

Here, as the filter means to be used as the first and second characteristic correcting sections in the present embodiment, in addition to the above-mentioned FIR type digital filters, the IIR type digital filters described in the first embodiment or analog filters can be used.

Figure 5:
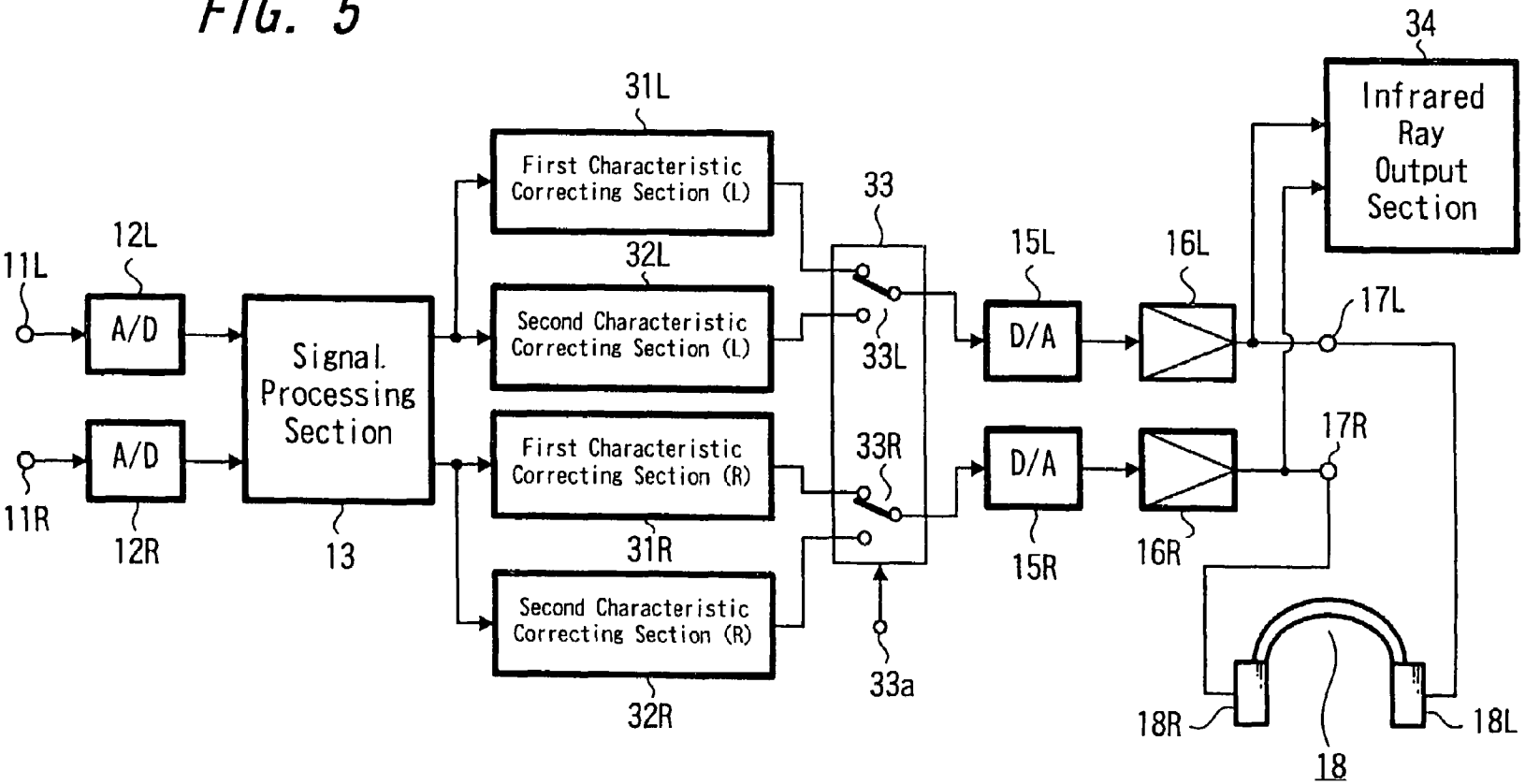
FIG. 5 is a block diagram showing an example of a whole structure according to a third embodiment of the present invention.

Next, there will be explained below a third embodiment of the present invention with reference to FIG. 5. In FIG. 5, the same reference numerals are given to the portions corresponding to those in FIG. 1 described in the first embodiment, and the detailed explanation thereof is omitted.

In the present embodiment, a headphone device, which is provided with an infrared ray output section in addition to the headphone connection terminals and is directly connected to the headphone connection terminals, or a codeless headphone device which receives an infrared signal from the infrared ray output section can be selectively used.

There will be explained below a structure of the present embodiment. FIG. 5 is a diagram showing a whole structure of the present embodiment. A left channel signal and a right channel signal composing two-channel audio signals for stereophonic reproduction are supplied to the left channel audio signal input terminal 11L and the right channel audio signal input terminal 11R, respectively. The audio signals obtained at the terminals 11L and 11R respectively are converted into digital audio signals by the analog/digital converters 12L and 12R for the respective channels, and are supplied to the signal processing section 13. The converted digital audio signals of the respective channels are supplied to the signal processing section 13. The signal processing section 13 is a circuit for converting the digital audio signals into two-channel audio signals forming a sound field for headphone reproduction based on two-system impulse responses from a sound source to the left ear and right ear of a listener. This part of the structure is the completely same as that of the circuit described in the first embodiment.

Thereafter, the audio signal of the left channel processed in the signal processing section 13 is supplied to a first characteristic correcting section 31L for the left channel, and the audio signal of the right channel processed in the signal processing section is supplied to a first characteristic correcting section 31R for the right channel. Headphone characteristics which have assumed the headphone device 18 connected to the headphone connection terminals 17L and 17R (namely, transfer characteristics from the drivers to both ears of the listener) are corrected in the first characteristic correcting sections 31L and 31R, respectively.

Further, the audio signal of the left channel processed in the signal processing section 13 is supplied to a second characteristic correcting section 32L for the left channel, and the audio signal of the right channel processed in the signal processing section 13 is supplied to a second characteristic correcting section 32R for the right channel. Headphone characteristics which have a codeless headphone device (not shown) are corrected in the second characteristic correcting sections 32L and 32R, respectively. The structure of the respective characteristic correcting sections is the same as that of the characteristic correcting sections described in the first and second embodiments, and filter means such as FIR type digital filters, IIR type digital filters and analog filters are used.

The right and left audio signals corrected in the first characteristic correcting sections 31L and 31R and the right and left audio signals corrected in the second characteristic correcting sections 32L and 32R are supplied to a change-over switch 33. The change-over switch 33 selects one pair of the audio signals based on a control signal obtained at a control terminal 33*a* so as to output the selected pair of the audio signals. The audio signals output from the change-over switch 33 are supplied respectively to the digital/analog converters 15L and 15R for the respective channels so as to be converted into analog audio signals. The analog audio signals of the two right and left channels are amplified by the amplifiers 16L and 16R and are supplied to the headphone connection terminals 17L and 17R and the infrared ray output section 34. Here, the control signal to be supplied to the control terminal 33*a* of the change-over switch 33 is generated, for example, based on operation of an operation key provided to this apparatus.

When the headphone device 18 is connected to the headphone connection terminals 17L and 17R, the audio is reproduced from the right and left speaker units 18L and 18R of the headphone device 18. Moreover, when the codeless headphone device (not shown) is prepared, the codeless headphone device receives the infrared signals output from the infrared ray output section 34 and reproduces the received audio.

Here, when the headphone device 18 is used, it is controlled by means of the operation key so that the change-over switch 33 selects output of the first characteristic correcting sections 31L and 31R and the audio signals corrected in the first characteristic correcting sections 31L and 31R are supplied from the headphone connection terminals 17L and 17R to the headphone device 18. Moreover, when the codeless headphone device is used, it is controlled by the operation key so that the change-over switch 33 selects the output of the first characteristic correcting sections 31L and 31R and the audio signals corrected in the second characteristic correcting sections 32L and 32R are supplied to the infrared ray output section 34.

According to this structure, in both the cases where the headphone device 18 is directly connected to the headphone connection terminals 17L and 17R and the codeless headphone device is used, a difference of the respective headphone characteristics is corrected suitably only by operating the change-over switch 33 so that the characteristics become satisfactory. In the case of the structure of the present embodiment, the two headphone devices can not be used simultaneously, but only one pair of the circuit configuration for outputting audio signals (digital/analog converters 15L and 15R and amplifiers 16L and 16R) is sufficient. Namely, the circuit configuration can be simplified.

Here, changing over of the change-over switch 33 is carried out based on operation of the operation key in the above-mentioned example, but, for example, a structure may be established so that when plugs of the headphone device are inserted into the headphone connection terminals 17L and 17R, the first characteristic correcting sections 31L and 31R are selected, and when the plugs of the headphone device are not inserted into the headphone connection terminals 17L and 17R, the second characteristic correcting sections 32L and 32R are selected.

Figure 6:
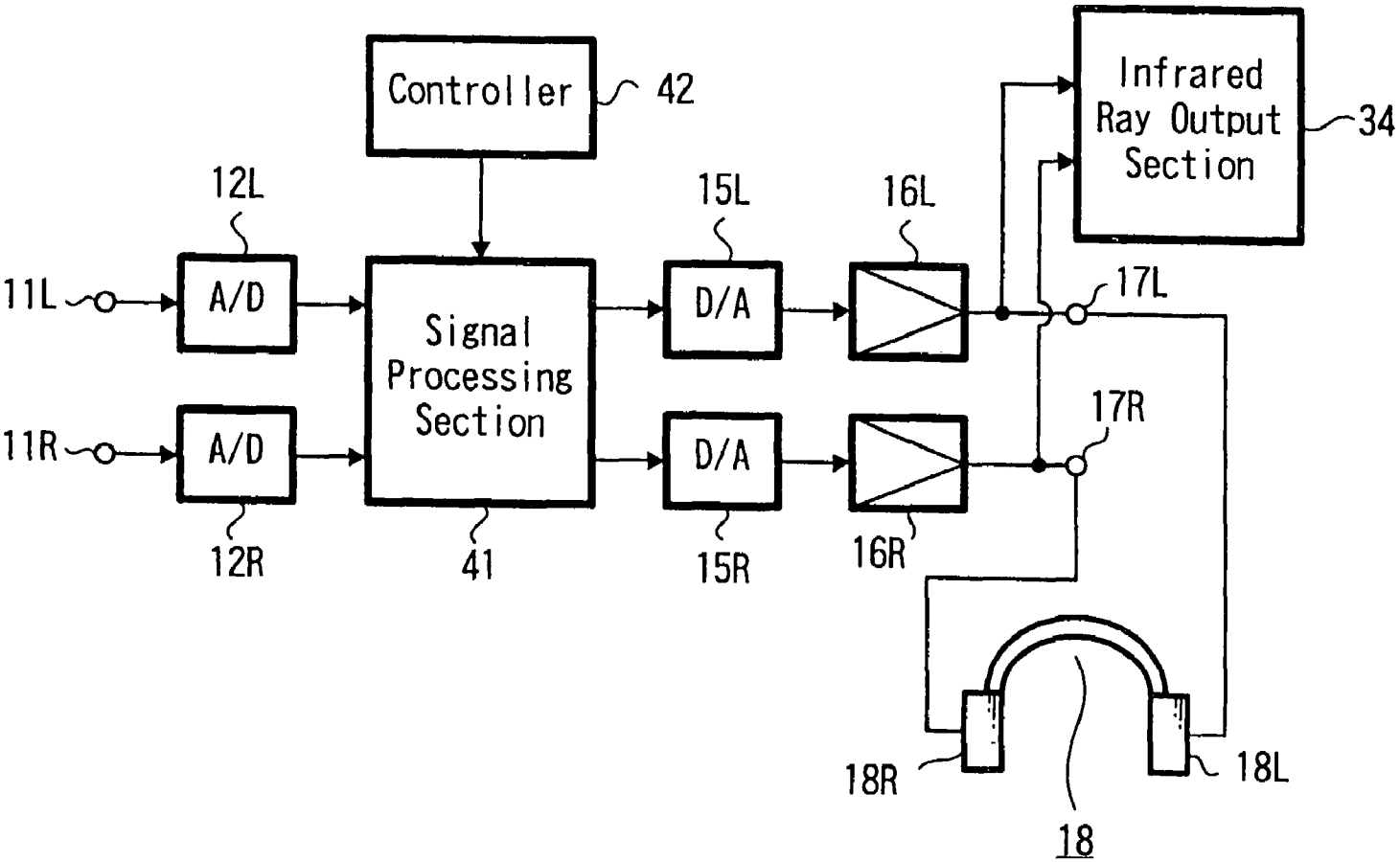
FIG. 6 is a block diagram showing an example of a whole structure according to a fourth embodiment of the present invention.

Next, There will be explained below a fourth embodiment of the present invention with reference to FIG. 6. In FIG. 6, the same reference numerals are given to the portions corresponding to those in FIGS. 1 and 5 described in the first and third embodiments, and the detailed explanation thereof is omitted.

In the present embodiment, similarly to the case of the third embodiment, the headphone device, which is provided with the infrared ray output section in addition to the headphone connection terminals and is directly connected to the headphone connection terminals, or the codeless headphone device which receives infrared signals from the infrared ray output section is selected to be used. The circuit configuration in this case is further simplified.

There will be explained below a structure of the present invention. FIG. 6 is a diagram showing a whole structure of the present embodiment. A left channel signal and a right channel signal composing two-channel audio signals for stereophonic reproduction are supplied to the left channel audio signal input terminal 11L and the right channel audio signal input terminal 11R. The audio signals obtained at the terminals 11L and 11R respectively are converted into digital audio signals by the analog/digital converters 12L and 12R for the respective channels so as to be supplied to the signal processing section 41. The signal processing section 41 is a circuit for executing the process for converting audio signals into 2-channel audio signals for forming a sound field for headphone reproduction based on a two-system impulse response from a sound source to listener's right and left ears and the process for correcting right and left headphone characteristics (namely, transfer characteristics from drivers of the headphone to the both ears of the listeners) simultaneously.

That is, a signal processing section (signal processing section 13 described in the first embodiment or the like), which converts audio signals for stereophonic reproduction into audio signals for binaural reproduction, is composed of filter means. A characteristic correcting section for correcting headphone characteristics is also composed of filter means, and here, one pair of filter means execute both the above processes. More concretely, the signal processing section 41 is constituted as a circuit including FIR type digital filters, for example. Coefficient values are set in the digital filters based on impulse response data for binaural reproduction and transfer characteristics from drivers to both ears of a listener so that both the processes can be executed simultaneously.

In this case, the coefficient values to be set in the coefficient multipliers of the digital filters in the signal processing section 41 are controlled by a controller 42. At least a first setting state or a second setting state can be selected. Here, the first setting state is a setting state that the correcting process is executed based on the headphone characteristics of the headphone device 18 connected to the headphone connection terminals 17L and 17R. The second setting state is a setting state that the correcting process is executed based on the headphone characteristics of the codeless headphone device for receiving infrared signals output from the infrared ray output section 34.

The right and left audio signals processed in the signal processing section 41 are supplied respectively to the digital/analog converters 15L and 15R for respective channels so as to be converted into analog audio signals. The audio signals for right and left two channels are amplified by the amplifiers 16L and 16R, and are supplied to the headphone connection terminals 17L and 17R and the infrared ray output section 34.

When the headphone device 18 is connected to the headphone connection terminals 17L and 17R, audio is reproduced from the right and left speaker units 18L and 18R of the headphone device 18. Moreover, when the codeless headphone device (not shown) is prepared, the codeless headphone device receives infrared signals output from the infrared ray output section 34 and reproduces the received audio.

Here, when the headphone device 18 is used, the coefficient multipliers of the digital filters in the signal processing section 41 are brought into the first setting state by controlling the controller 42. When the codeless headphone device is used, the coefficient multipliers of the digital filters in the signal processing section 41 are brought into the second setting state by controlling the controller 42.

According to this structure, in both the cases where the headphone device 18 is directly connected to the headphone connection terminals 17L and 17R and the codeless headphone device is used, a difference of the headphone characteristics is corrected suitably so that the characteristics become satisfactory. Here, in the case of the present embodiment, one pair of the signal processing section 41 having digital filters executes the converting process for converting into audio signals for binaural reproduction and the correcting process for correcting the headphone characteristics. For this reason, the circuit configuration can be simplified. Moreover, since one pair of the signal processing section 41 can execute two types of headphone characteristic correcting processes, one pair of the correcting section is sufficient. As a result, the circuit configuration is simplified.

Figure 7:
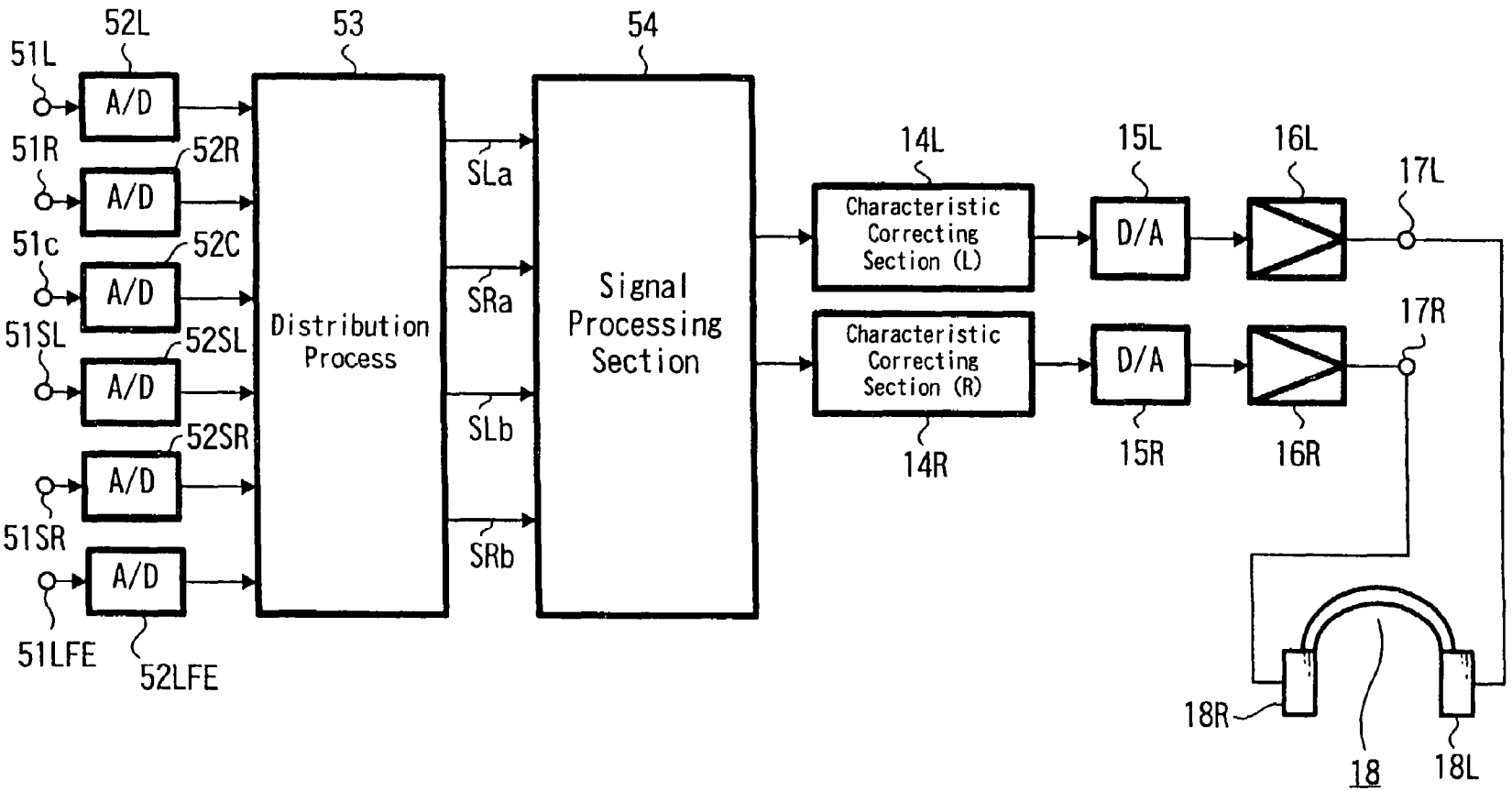
FIG. 7 is a block diagram showing an example of a whole structure according to a fifth embodiment of the present invention.

There will be explained below a fifth embodiment of the present invention with reference to FIG. 7. In FIG. 7, the same reference numerals are given to the portions corresponding to those in FIG. 1 described in the first embodiment, and the detailed explanation thereof is omitted.

In the present embodiment, multi-channel audio signals obtained at input terminals 51L and 51R, 51C, 51SL, 51SR and 51LFE respectively are converted into two-channel audio signals for binaural reproduction, and the signals are supplied to the headphone device connected to the apparatus so as to be reproduced.

There will be explained below a structure of the present embodiment. FIG. 7 is a diagram showing a whole structure of the present embodiment. The multi-channel audio signals supplied to the input terminals in this example are composed of 6-channel audio signals. A left front channel signal (signal of a channel that a sound image is localized in a left front portion) is obtained at the input terminal 51L, a right front channel signal (signal of a channel that a sound image is localized in a right front portion) is obtained at the input terminal 51R, a center channel signal (signal of a channel that a sound image is localized in a center front portion) is obtained at the input terminal 51C, a left rear channel signal (signal of a channel that a sound image is localized in a left rear portion) is obtained at the input terminal 51SL, a right rear channel signal (signal of a channel that a sound image is localized in a right rear portion) is obtained at the input terminal 51SR, and a signal for low-frequency signal channel is obtained at the input terminal 51LFE. Here, in the case of such a channel structure, the low-frequency channel is assumed as a 0.1 channel, and this channel is added to the remaining 5 channels so that the total is 5.1 channels. The low-frequency channel is a channel where only an audio signal lower than about 120 Hz, for example can be obtained.

The audio signals obtained at the input terminals 51L, 51R, 51C, 51SL, 51SR and 51LFE are supplied to individual analog/digital converters 52L, 52R, 52C, 52SL, 52SR and 52LFE for respective channels so as to be converted into digital audio signals, respectively. The converted audio signals for respective channels are supplied to a distribution processing section 53. The distribution processing section 53, for example, mixes the center channel signal with the right and left front channels signals uniformly, and mixes the low-frequency channel signal with another channel signal uniformly. As a result, four-channel signals: right and left front audio signals SLa and SRa; and right and left rear audio signals SLb and SRb are obtained.

The four-channel audio signals are supplied to the signal processing section 54 so as to be converted into right and left 2-channel audio signals whose sound sources are in different four positions surrounding a listener. The 2-channel audio signals are converted into audio signals for forming a sound field for headphone reproduction based on two-system impulse responses from the sound source to the light and left ears of the listener. These above processes are executed by operation using the digital filters.

The left channel audio signal processed in the signal processing section 54 is supplied to the characteristic correcting section 14L for the left channel, and the right channel audio signal processed in the signal processing section 54 is supplied to the characteristic correcting section 14R for the right channel. The headphone characteristics are corrected in the characteristic correcting sections 14L and 14R, respectively. The correcting process in the characteristic correcting sections 14L and 14R here is the same as that described in the first embodiment, and an FIR type digital filter is used.

The right and left audio signals corrected in the characteristic correcting sections 14L and 14R are supplied to the digital/analog converters 15L and 15R for the respective channels so as to be converted into analog audio signals. The right and left two-channel analog audio signals are amplified by the amplifiers 16L and 16R and are supplied to the headphone connection terminals 17L and 17R so that audio is reproduced from the headphone device 18 connected to the headphone connection terminals 17L and 17R.

According to this structure, the multi-channel audio signals form the sound field where sound source is in the positions surrounding a listener who wears the headphone device 18 so that the multi-channel audio signals can be reproduced satisfactorily. In this case, similar to the case of the first embodiment, the transfer characteristics from the drivers of the headphone to both the ears of the listener are corrected. For this reason, the sound source can be heard from the accurate positions.

Here, the present embodiment has explained the process in the case where 5.1-channel audio signal is input as multi-channel audio signals, but needless to say, the present invention is applicable to a case of multi-channel audio signals having another channel structure.

In addition, in the case where the multi-channel audio signals are reproduced, the processes of correcting a plurality of headphone characteristics described in the second, third and fourth embodiments may be executed simultaneously or selectively.

Further, in the second, third and fourth embodiment, the process for correcting two sets of headphone characteristics can be executed, but a process for executing three or more sets of headphone characteristics may be executed.

Having described preferred embodiments of the invention with reference to the accompanying drawings, it is to be understood that the invention is not limited to those precise embodiments and that various changes and modifications could be effected therein by one skilled in the art without departing from the spirit or scope of the invention as defined in the appended claims.

What is claimed is

1. An audio processing apparatus comprising:

converting means for converting n channel (where n is a positive integral number: n≧1) audio signals supplied from at least one signal source into two binaural output signals;

first left and right correcting filter means to which two binaural signals converted by said converting means are respectively supplied, said first left and right correcting filter means having respective first left and right coefficients for correcting a difference of a sense of hearing due to a difference of a sense of hearing between right and left characteristics of right and left speaker units of a first pair of headphones, wherein an inverse transfer characteristic of the right channel is superimposed as impulse response data on a time area of the first right correcting filter means and an inverse transfer characteristic of the left channel is superimposed as impulse response data on. a time area of the first left correcting filter means;

second left and right correcting filter means to which the two binaural signals converted by said converting means are respectively supplied, said second left and right correcting filter means having respective second left and right coefficients different than said first left and right coefficients for correcting a difference of a sense of hearing between left and right characteristics of left and right speaker units of a second pair of headphones, wherein an inverse transfer characteristic of the right channel from the right speaker unit of the second pair of headphones is superimposed as impulse response data on a time area of the second right correcting filter means and an inverse transfer characteristic of the left channel from the left speaker unit of the second pair of headphones is superimposed as impulse response data on a time area of the second left correcting filter means;

a selector switch for selecting outputs of said first left and right correcting filter means or outputs of said second left and right correction filter means; and an output section connected to outputs of said selector switch for supplying a pair of output signals respectively to the right and left speaker units of the first pair of headphones or to the right and left speaker units of the second pair of headphones, wherein the output section includes an infrared ray output section for wirelessly transmitting the pair of output signals to the right and left speaker units of the second pair of headphones.

* * * * *

UNITED STATES PATENT AND TRADEMARK OFFICE

CERTIFICATE OF CORRECTION

PATENT NO. : 7,567,682 B2
APPLICATION NO. : 11/107633
DATED : July 28, 2009
INVENTOR(S) : Yuji Yamada, Hirofumi Kurisu and Kiyofumi Inanaga It is certified that error appears in the above-identified patent and that said Letters Patent is hereby corrected as shown below:

On the Title Page

Item (*) Notice, please add reference to the Terminal Disclaimer filed.

Signed and Sealed this
Fifteenth Day of March, 2011

David J. Kappos

David J. Kappos
*Director of the United States Patent and Trademark Office*